US005230513A

United States Patent [19]

Rouse

[11] Patent Number: 5,230,513

[45] Date of Patent: * Jul. 27, 1993

[54] GOLF STROKE TRAINING ATTACHMENT

[76] Inventor: Christopher D. Rouse, 6111 Parkway Dr., Baltimore, Md. 21212

[ * ] Notice: The portion of the term of this patent subsequent to Oct. 6, 2009 has been disclaimed.

[21] Appl. No.: 832,946

[22] Filed: Feb. 10, 1992

Related U.S. Application Data

[63] Continuation-in-part of Ser. No. 760,610, Sep. 16, 1991.

[51] Int. Cl.[5] ..... A63B 69/36

[52] U.S. Cl. ..... 273/187.2; 273/189 R; 273/186.1

[58] Field of Search ..... 273/183 B, 188 R, 189 R, 273/186 C, DIG. 30, 54 BA, 183 E; 2/160, 161 R, 161 A; 33/262

[56] References Cited

U.S. PATENT DOCUMENTS

| | | | |
|---|---|---|---|
| Re. 16,272 | 2/1926 | Green | 2/160 X |
| 1,309,150 | 7/1919 | Monfort | 2/160 X |
| 3,130,971 | 4/1964 | Boccardi et al. | 273/67 B |
| 3,206,200 | 9/1965 | Butan | 273/54 BA |
| 3,278,944 | 10/1966 | Gowers | 273/183 B |
| 3,762,719 | 10/1973 | Smith | 273/183 B |
| 3,774,572 | 11/1973 | Borraccio | 273/183 B X |
| 3,811,684 | 5/1974 | Tredway, Sr. | 273/183 B |
| 3,848,874 | 11/1974 | Elkins, Jr. | 273/183 B |
| 4,257,607 | 3/1981 | Nedwick | 273/183 B |

*Primary Examiner*—William Stoll
*Attorney, Agent, or Firm*—Leonard Bloom

[57] ABSTRACT

A golf stroke training device to be worn on the backside of a golfer's leading hand for indicating if the golfer's leading hand is properly aligned during the golfer's stroke relative to a target line of direction. The device includes a base which has a pointer mounted thereon and extending outwardly therefrom. The longitudinal axis of the pointer substantially perpendicularly intersects the base and the backside of the golfer's leading hand. During the golfer's stroke, the orientation of the longitudinal axis of the pointer either perpendicular or parallel to the vertical plane of the target line of direction and the horizontal plane of the ground may be observed for indicating whether the backside of the golfer's leading hand is properly aligned during the golfer's stroke. The device is attached to an elastic band which is worn about the golfer's hand. The band has at least one fastener on the first side thereof to which the training device is removably attached. In an alternate embodiment, the device is attached to a strap which is worn about the golfer's hand. In still another embodiment, the training device is attached to the head of a golf club.

12 Claims, 11 Drawing Sheets

GOLF STROKE TRAINING ATTACHMENT

CROSS-REFERENCE TO RELATED APPLICATION

This application is a continuation-in-part of co-pending application Ser. No. 760,610 filed Sep. 16, 1991, the disclosure of which is incorporated by reference herein in its entirety.

FIELD OF THE INVENTION

The present invention relates to devices and methods for training a golfer in order to improve and correct the golfer's golf stroke and, in particular, to devices that are attachable to a golf glove of, the golfer's leading hand for improving and correcting the golfer's golf stroke.

BACKGROUND OF THE INVENTION

One of the most challenging aspects of the sport of golf is for the golfer to develop a proper stroke. With a proper stroke, when the golfer strikes the golf ball, the ball travels to the target (usually the hole) in a straight path, usually referred to as the ball's flight path or as the target line of direction, which is an imaginary substantially straight line that extends from the target and through the ball. This line of direction is an important guide as a control for the direction of travel for the backward and forward swing arcs of the golfer's stroke.

To achieve the goal of properly striking the golf ball, the golfer must not only correctly grip the shaft of the golf club, but must also insure that his or her hands are properly oriented throughout their stroke. In this manner, when the golf club is gripped properly, the golfer may insure that the face of the golf club is always properly oriented for striking the ball.

While the stance and stroke effected by many golfer's may vary, it is generally accepted that, during a proper golf stroke, the face of the golf club and the back of the golfer's leading hand should be coincidental in relation to the target proper. In right-handed individuals, the golfer's leading hand is the golfer's left hand and, in left-handed individuals, the golfer's leading hand is the golfer's right hand. If the back of the golfer's leading hand and the face of the golf club are oriented properly during the golfer's golf stroke, then the golf ball should proceed towards the target along the target line of direction.

To aid in providing for the proper orientation of the golfer's hands, numerous devices have been disclosed.

Several devices have been disclosed which attempt to provide a proper positioning of the golfer's hands in respect to the golf club by placing a peak, mound, or some raised disc on the back of the thumb portion of a golf glove. In this manner, the peak, mound, etc., permits a golfer to feel or sense any separation between his or her hands during a golf stroke. However, in that each golfer's stroke is individualistic and each grip is highly varied, such raised elements may interfere with a number of golfer's grips and may also lead to the golfer incorrectly striking the golf ball.

A similar device is disclosed in U.S. Pat. No. 4,257,607 issued to Nedwick. In that disclosure, an arrowhead-shaped device is attached to the belt of the golfer and another such device is attached to the back of the golfer's hand. To determine if the golfer's stroke is correct, a second person (the golf instructor) must eyeball both of these devices and form an imaginary triangle. It cannot be utilized by one person alone. However, such a determination requires the instructor to not only perform complicated eyeballing of the two devices, but it also requires the instructor to form proper calculations in order to determine if the golfer's stroke is correct. Also, due to the wind resistance offered by the device attached to the hand of the golfer, the actual stroke of the golfer is affected and made more difficult.

Furthermore, with the use of such a device, the golfer may still flex his or her wrists, so that even with the use of that device, the back of the golfer's hands would not properly align. This is the case even though it may appear to the instructor that the golfer's hands are properly aligned. Accordingly, it can be seen that use of that device may result in incorrect instruction.

Also, due to the various elements of the device of Nedwick, the use of that device in the field (on the golf course itself) is extremely limited.

Finally, while perhaps being useful for correcting particular golf strokes, such as tee strokes, these devices are of little aid for correcting other golf strokes, such as the putting stroke.

Other devices that have been disclosed for correcting a golf stroke include sensory means that warn the golfer if their stroke is proper or improper. Examples of such devices can be found in U.S. Pat. Nos.: 4,776,595 issued to Wilkins; 3,918,721 issued to Trask, Jr.; and 3,707,291 and 3,811,684 issued to Tredway, Sr.

While being useful for their purposes, such devices are complicated, expensive and not readily adaptable for use while the golfer is actually playing on the golf course. Also, such devices (particularly in the case of Wilkins) can interfere with or effect the golfer's stroke.

In U.S. Pat. No. 4,167,268 issued to Lorang, a device is disclosed which is attached to the golf club itself in order to aid in properly swinging the golf club during a putting stroke. Unfortunately, this device, must be directly attached to a golf club. As such, this device can easily affect the golfer's stroke by adding weight to the club, or otherwise effecting the way in which the golf club feels in the golfer's hand. Also, such a device is not readily usable in the field. Finally, such a device is only useful for improving a golf putting stroke and is not useful to aid in improving other golf strokes, such as a drive or a chip stroke.

It has also been disclosed to provide both golf gloves and golf clubs for use therewith, which are equipped with indicia means. The indicia means are to be aligned when the golfer, wearing the golf glove equipped with such indicia, grips the golf club that is also equipped with such indicia. An example of such an arrangement is U.S. Pat. No. 3,848,874 issued to Elkins, Jr. Unfortunately, such an arrangement requires the provision not only of a special golf glove, but also of a set of special golf clubs, which can be quite expensive, especially for a beginner, just the type of person most likely to have need of the use of such devices.

To try to correct such a defect, in U.S. Pat. Nos. 4,962,547 issued to Minnick and 3,278,944 issued to Gowers, gloves have been disclosed that include areas that are incorporated therein which aid the golfer to have proper hand alignment. While being unobtrusive, such arrangements are of little value in indicating to either the user thereof, or to the instructor of such a user, whether or not twisting of either the golfer's hands, wrists or body occurs. Such twisting can also effect the golf stroke, so that such a device may neither detect nor be useful for correcting undesired motions in the golfer's stroke.

Thus, it can be seen that there remains a need for a device that may be utilized with existing and conventional golf gloves and golf clubs and also may be utilized by golfers without golf gloves. It can further be seen that there remains a need for such a device which permits either the golfer himself or herself, or the golfer's instructor, to easily and simply determine if the back of the golfer's leading hand is properly positioned during all manners of golf strokes, including both a golf tee stroke and a golf putting stroke. It can still further be seen that there remains a need for such a device which is substantially unobtrusive and which may be used in the field without effecting the golfer's stroke.

SUMMARY OF THE INVENTION

A primary object of the present invention is to provide a device useful for training and correcting all manner of golf strokes, including both the tee stroke, chip strokes and the putting stroke.

A further primary object of the present invention is the provision of a training device that either a golfer, or a golfer's training instructor, may easily and readily view for instantly determining whether the back of the golfer's leading hand is properly positioned during the entire golf stroke, including the backswing portion of the golf stroke, the impact point portion of the golf stroke and the forward swing portion of the golf stroke.

Yet another object of the present invention is to provide a device which may be used for self-instruction by a golfer to easily and readily determine the position of the golfer's own hand in relation to the club during the swing of the golf club.

A still further object of the present invention is to provide such a device which may be utilized not only in special training locations, but which may also be utilized in the field, such as when the golfer is actually on the golf course itself.

A still yet further object of the present invention is to provide such a device that may be utilized with conventional golf gloves and golf clubs and by golfers without golf gloves.

In accordance with the teachings of the present invention, a golf stroke training device to be worn on the backside of the golfer's leading hand is disclosed. The device includes means for wearing the training device on the golfer's hand and a base that is secured to the means for wearing the device on the golfer's leading hand. A pointer is mounted on the base, so as to extend outwardly therefrom and from the back of the golfer's leading hand. The pointer is disposed on a longitudinal axis that substantially perpendicularly intersects both the base and the back of the golfer's leading hand. In this manner, when during the golfer's stroke, the orientation of the longitudinal axis of the pointer in relation to both the vertical plane of the target line of direction and the horizontal plane of the ground may be observed for indicating whether the backside of the golfer's leading hand is properly aligned during the golfer's stroke.

Preferably, the pointer is a dowel rod.

It is further preferred that the mean for wearing the device on the golfer's hand be an elastic band having a first end, a second end, a first side and a second side. At least one attachment means is mounted on the first side near the first end thereof. A second attachment means is mounted on the second side near the second end thereof. The elastic band may be wrapped about the golfer's hand.

It is also preferred that the attachment of the training device include a means for removably securing the attachment on the backside of the means for wearing the device on the golfer's leading hand. Preferably, this means includes straps that are carried by the base and which include hook and loop fasteners. The hook and loop fasteners mate with respective hook and loop fasteners that are secured to and form a part of the backside of the means for wearing the device on the golfer's hand.

Within the concept of the present invention, a golf instructor, or even the golfer himself or herself, can tell whether a golfer's stroke is correct simply by noting the orientation of the pointer of the attachment relative to both the vertical plane of the ball's flight path (or the target's line of direction) and the horizontal plane of the ground. In this regard, such a determination can be accurately made merely by noting whether the pointer of the attachment is either perpendicular or parallel to both the vertical plane of the ball's flight path (or the target's line of direction) and the horizontal plane of the ground, in a manner that shall be discussed below. Such determination may be made without the need for any further complicated assessments or calculations.

These and other objects of the present invention will become readily apparent from a reading of the following specification, taken in conjunction with the enclosed drawings.

BRIEF DESCRIPTION OF THE DRAWINGS

FIG. 3 illustrates the training device being positioned on the top side of the securing strap of a conventional golf glove and how the straps of the training device are looped around and removably secured to the bottom side of the securing strap.

FIG. 4 illustrates the securing strap of the golf glove being closed, such that the glove is secured on the golfer's leading hand with the training device being secured in place on the back of the golfer's leading hand.

FIG. 5 is a cross-section view taken along lines 5—5 of FIG. 4.

FIG. 7 illustrates the proper vertical orientation of the training device of the present invention at the apex of the golfer's backswing.

FIG. 8 illustrates the proper vertical orientation of the training device of the present invention at the point of impact of the golf ball.

FIG. 9 illustrates the proper vertical orientation of the training device of the present invention at the apex of the golfer's forwardswing.

FIG. 10 shows the proper vertical orientation of the device relative to the vertical plane of the ball's flight path during "set-up".

FIG. 11 shows proper and improper vertical orientations of the device relative to the vertical plane of the ball's flight path at the top (apex) of the golfer's backswing.

FIG. 12 shows proper and improper vertical orientations of the device relative to the vertical plane of the ball's flight path at the point of impact during the golfer's forward swing, when the head of the golf club strikes the ball.

FIG. 13 shows proper and improper vertical orientations of the device relative to the vertical plane of the ball's flight path at the top (apex) of the golfer's follow-through during the forward swing.

FIG. 14 shows proper and improper horizontal orientations of the device relative to the horizontal plane of the ground at the top (apex) of the golfer's backswing.

FIG. 15 shows proper and improper horizontal orientations of the device relative to the horizontal plane of the ground at the point of impact during the golfer's forward swing, when the head of the golf club strikes the ball.

FIG. 16 shows proper and improper horizontal orientations of the device relative to the horizontal plane of the ground at the top (apex) of the golfer's follow-through during the forward swing.

DESCRIPTION OF PREFERRED EMBODIMENTS

Figure 1:
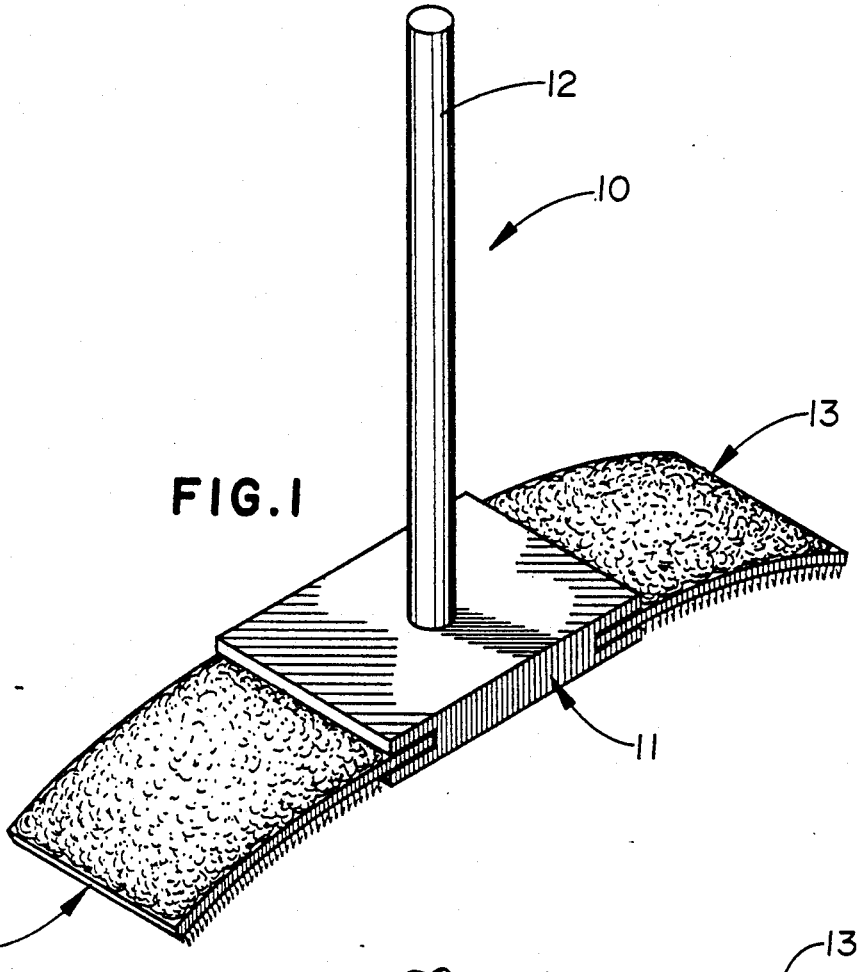
FIG. 1 is a perspective view of the training device of the present invention.
Figure 2:
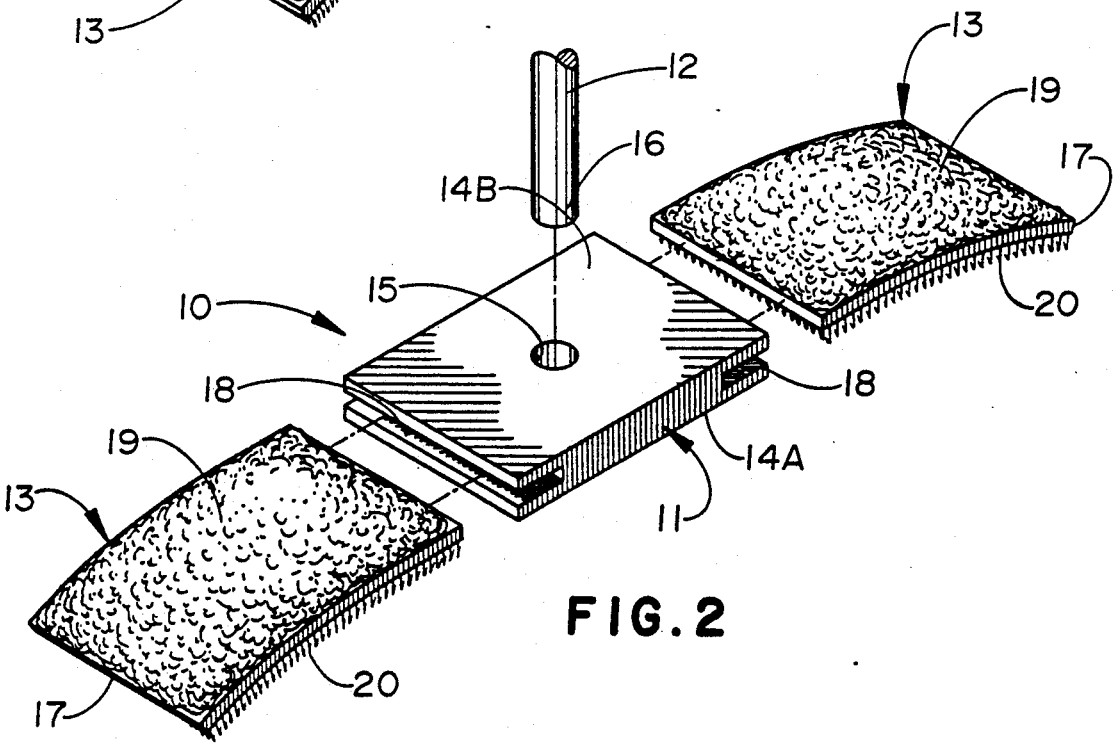
FIG. 2 is an exploded view of the training device of FIG. 1.

Referring now to the drawings, and in particular to FIGS. 1 and 2, the attachment 10 of the present invention is seen to include a base 11, a pointer 12 and means 13 for removably securing the device 10 to the backside of the golf glove worn on a golfer's leading hand.

The base 11 of the device 10 of the present invention is a flat member having a pair of substantially parallel opposite sides 14A and 14B. When the base 11 is secured to the backside of the glove worn on the golfer's leading hand, one of the sides (the bottomside) 14A thereof is disposed against the glove, as will be discussed at length below. The other of the sides (the topside) 14B faces outwardly from the backside of the said glove. In this manner, the base 11 is disposed parallel with the backside of the golfer's leading hand.

The base 11 may be fabricated from any suitable lightweight material, such as wood or plastic. It is also preferred that the topside 14B of the base 11 have a hole or blind-ended bore 15 formed therein for receiving therein the pointer 12, as will be discussed, so that the pointer 12 may be mounted on the base 11.

Preferably, the base 11 is formed so as to be substantially 1 inch by 1 and ½ inch.

The pointer 12 is mounted on the base 11 (preferably centrally of the base 12), so as to extend outwardly therefrom. The pointer 12 is in the form of a pointer rod such as a wood dowel, plastic or metal that is disposed on a longitudinal axis which substantially perpendicularly intersects the plane of the base 11 (as well as the plane of the backside of the golfer's leading hand). In this fashion, a substantially ninety degree angle is formed between the longitudinal axis and the plane of the base 11. Preferably, the pointer 12 is secured to the base 11 by having a first lower end 16 of the pointer 12 being frictionally received in the hole or blind-ended bore 15 that is formed in the base 11, so that the pointer 12 is retained therein. In this respect, the pointer 12 may be either removably retained, as by i.e., friction, or glue or any other suitable means may be employed for permanently securing the pointer 12 in the bore 15.

The pointer 12 may be of any desired length. In a preferred embodiment, the pointer 12 is approximately four (4) inches in length. However, a pointer 12 of approximately twelve (12) inches may also be employed for use during practice swings, wherein the golfer would stop movement of the arms at the critical points during the golf stroke and check the position and orientation of the pointer 12 with respect to the club and the ball's flight path, as shall be discussed at length below. In this regard, a longer pointer 12 may be more easily seen by the golfer.

Also in order to increase the visibility of the pointer, it is preferred that the pointer be painted with a distinctive fluorescent or highly visible color. When the pointer is made of plastic, the color can be formed in body of the pointer.

It is noted that the use of the pointer 12 presents an attachment 10 that offers little wind resistance during the golf stroke. The base 11 is soundly attached to the golfer's glove 1 and the pointer 12 rides through the air. Hence, unlike other devices which present areas of large wind resistance that may effect the user's golf stroke, the attachment 10 of the present invention is aerodynamically sound. In this manner, the attachment 10 is particularly suited for use in the field.

The means 13 for removably securing the attachment 10 to the backside of a conventional golf glove 1 that is worn on the golfer's leading hand includes a pair of fastener straps 17. Each of the straps 17 is slidingly disposed and secured in a respective slot 18 that are formed in the two opposite edges of the base 11, so as to extend outwardly therefrom. Any suitable means, well-known to those skilled in the art, may be utilized to secure the straps 17 in the respective slots 18. Alternately, a channel 24 may be formed which extends longitudinally through the base and the strap 17 is formed as a single piece which is received in the channel 24 and extends outwardly from both sides of the base 11. In both embodiments, the straps 17 are carried by the base 11.

Each of the fastener straps 17 incorporate loop fasteners 19 and hook fasteners 20. These loop 19 and hook 20 fasteners are so provided in order to mate with respective hook fasteners 3 and loop fasteners 4 that are located on the securing strap 2 and the backside of conventional golf gloves 1. In conventional golf gloves 1, the hook 3 and loop 4 fasteners permit the strap 2 of the golf glove 1 to be easily closed, so that the glove 1 may be worn, or easily opened, so that the glove 1 may be placed on or removed from the golfer's hand.

As perhaps best seen in FIGS. 1 and 2, it is preferred that the loop fasteners 19 are formed, so as to be on the top surface of each of the straps 17, while the hook fasteners 20 are formed, so as to be on the bottom surface of each of the straps 17. This is because conventional golf gloves have the loop fasteners 4 thereof incorporated on the bottomside (underside) of the securing strap 2 while the hook fasteners 3 are incorporated on the backside of the glove 1.

Figure 3:
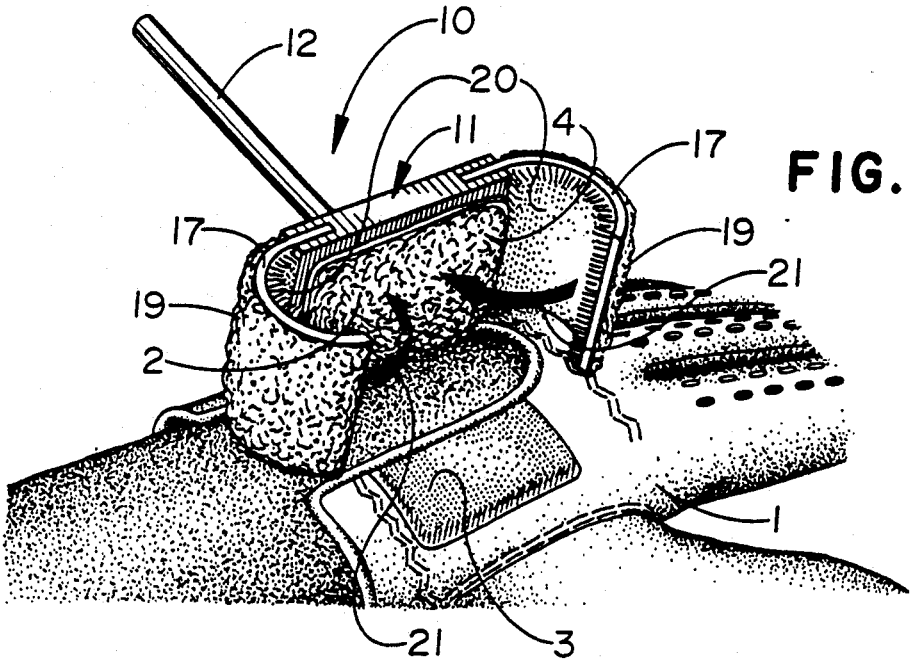
FIGS. 3–5 illustrate the means for removably securing the training device to the backside of a conventional golf glove that is worn on the golfer's leading hand.
Figure 4:
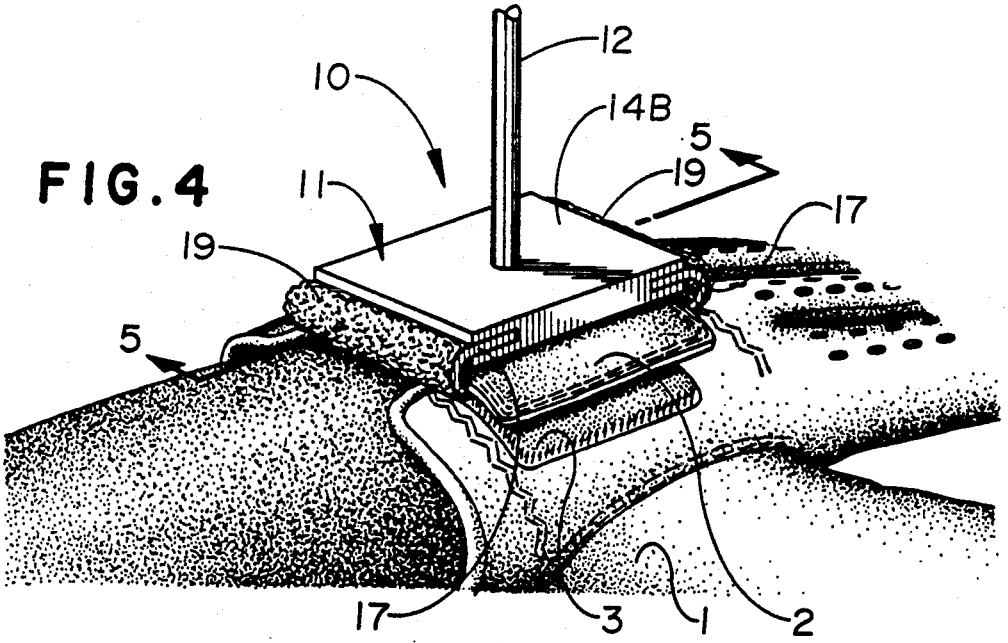
Figure 5:
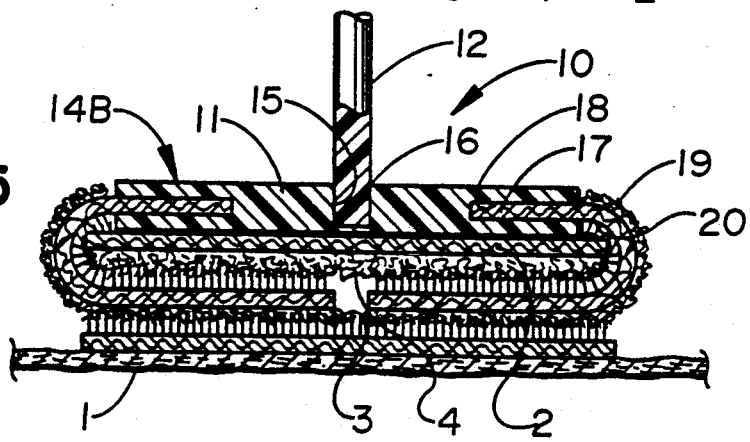

Referring now to FIGS. 3–5, the manner in which the straps 17 are utilized to secure the attachment 10 to the backside of a conventional golf glove 1 of the golfer's leading hand is now discussed.

First, the base 11 of the attachment is placed or positioned on the top side of the securing strap 2 that is provided on conventional golf gloves.

Next, the straps 17 are looped in the direction indicated by the arrows 21 in FIG. 3 around the bottomside of the securing strap 2. In this fashion, the hook fasteners 20 that are carried by the straps 17 mate with the loop fasteners 4 that are conventionally found on the underside (or bottomside) of the securing strap 2. In this manner, the attachment 10 is secured to the securing strap 2 that is located on the backside of conventional golf gloves 1 which are worn on the golfer's leading hand.

Finally, with particular reference to FIGS. 4 and 5, the loop fasteners 20 that are carried by the straps 17 are bought into contact with the hook fasteners 3 that are found on the backside of the glove 1, such that the loop fasteners 20 are engaged and secured by the hook fasteners 3. In this fashion, the attachment is removably secured to the backside of the golf glove 1 on the golfer's leading hand. Also, in this fashion, the securing strap 2 is closed and the conventional golf glove is secured on the user's leading hand for use.

It is noted that when the attachment 10 of the present invention is secured to the backside of the golf glove 1 in the manner described above, the longitudinal axis of the pointer 12 is oriented, so as to substantially perpendicularly intersect both the base 11 and the back of the golfer's leading hand. This is perhaps best seen by reference to FIG. 4.

It is further noted that when provided with the means 13 described above, the attachment 10 of the present invention may be easily and simply removably secured to the glove 1, so that it is always properly positioned for use. In this manner, having the device 10 improperly installed is avoided. Further in this manner, the attachment 10 may be utilized with virtually all existing conventional golf gloves 1 and existing golf clubs, thereby eliminating the necessity to purchase specialized equipment.

Figure 6:
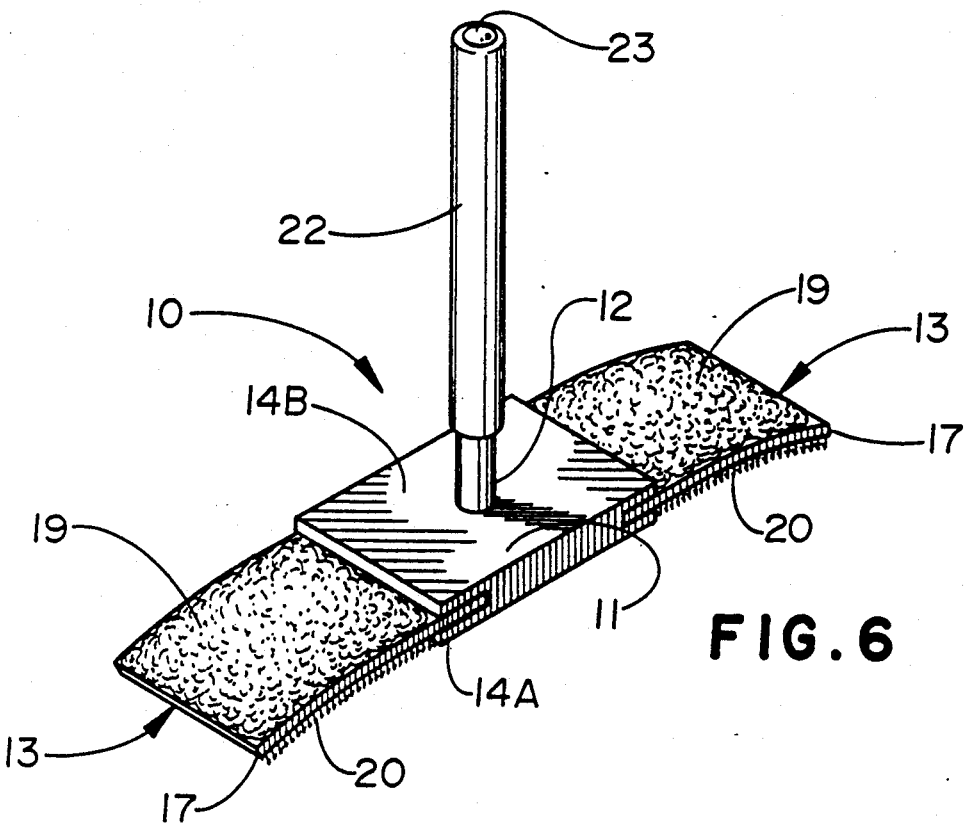
FIG. 6 illustrates the training device of FIG. 1, with a flashlight incorporated therein to facilitate the golfer's use of the device when alone.

Referring now to FIG. 6, if desired, the attachment 10 may further include a small, lightweight flashlight 22 which could be slipped over or fixed to the pointer 12 and secured to the base 11 by the use of velcro or any other suitable means. Preferably, such a flashlight 22 is substantially cylindrical in shape having an upper end that includes the light source 23 and a lower end that has a blind ended bore formed therein which permits the top end of the pointer 12 to be snugly, but removably, disposed in the bore of the flashlight 22. Such an arrangement is preferred in that it permits that the light 23 to be coaxial with the longitudinal axis of the pointer 12. This feature would facilitate the user's use of the attachment 10 to practice their golf stroke at their leisure in the home, office or any other desired place.

With the attachment 10 of the present invention being secured to the backside of the glove 1 worn on the golfer's leading hand, either the instructor or the golfer may simply and easily view whether the backside of the golfer's leading hand is properly oriented both vertically and horizontally. This may be achieved by viewing the attachment 10, and in particular by viewing the direction in which the pointer 12 of the attachment 10 is oriented (or pointing). In this respect, either the golfer or the instructor must simply note whether the attachment 10 is either perpendicular to, or parallel to, the vertical plane of the target line of direction 5.

Figure 7:
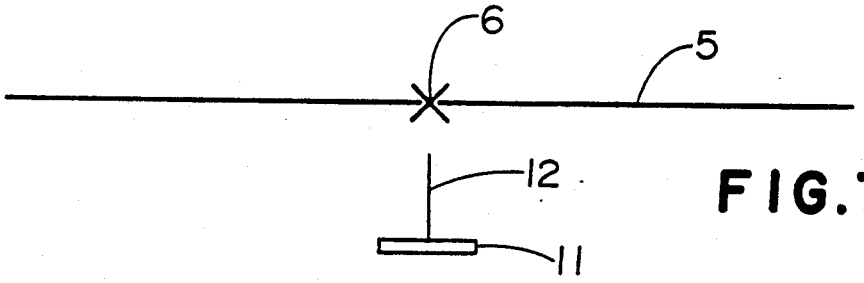
FIGS. 7–9 schematically illustrate the proper vertical orientation of the pointer of the training device of the present invention during various positions of a golf stroke.
Figure 8:
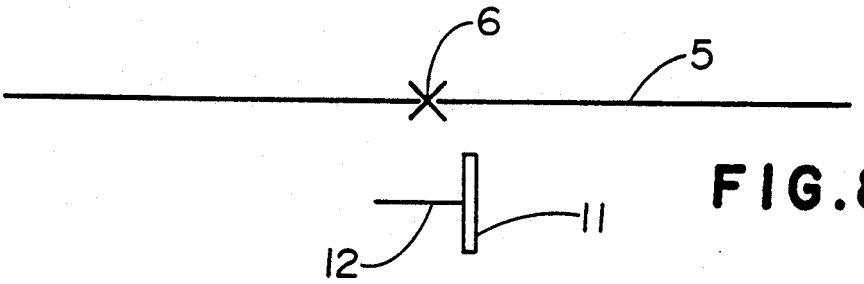
Figure 9:
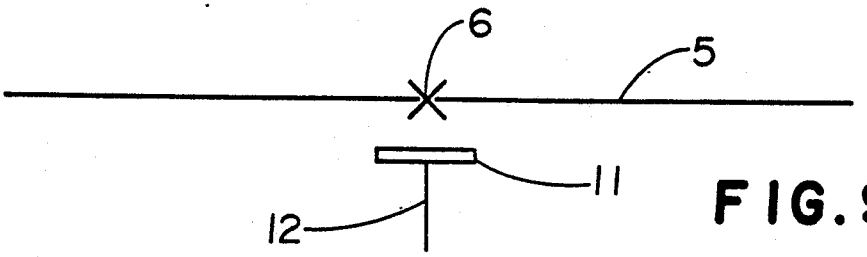

Referring now to FIGS. 7–9, the proper vertical orientation of the longitudinal axis 23 of the pointer 12 relative to vertical plane 5 of the ball's flight path or target line of direction during various critical positions of a golf stroke are illustrated.

At the apex of the backswing of the golfer's stroke, it is necessary that the longitudinal axis of the pointer 12 be oriented towards the vertical plane 5 of the ball's flight path, so as to be perpendicular to the said vertical plane 5 of the ball's target line of direction, so that a substantially 90° angle is formed therebetween (FIG. 7).

At the point of the forward swing of the golf stroke where the head of the golf club impacts the ball (the point of impact), it is necessary that the longitudinal axis of the pointer 12 be oriented forwardly towards the target and substantially parallel to the vertical plane of the target line of direction (FIG. 8).

At the apex of the forward swing of the golfer's stroke, it is necessary that the longitudinal axis of the pointer 12 be oriented rearwardly away from the target and substantially parallel to the vertical plane 5 of the ball's target line of direction (FIG. 9).

Referring now to FIGS. 10–13, when looking down on the golfer utilizing the training attachment 10 of the present invention, the proper as well as common improper vertical orientations of the pointer 12 relative to the vertical plane 5 of the flight path (target line of direction) of the ball 6 are illustrated during the critical points of the golfer's golf stroke.

When addressing a golf ball, the golfer makes a golf stroke that is substantially even, so that when the face of the head of the golf club strikes the ball 6, the ball 6 will travel along the vertical plane 5 of the target line of direction and towards the desired target. In this respect, the movement of the golf club during the golf stroke will travel substantially along the vertical plane 5.

Figure 10:
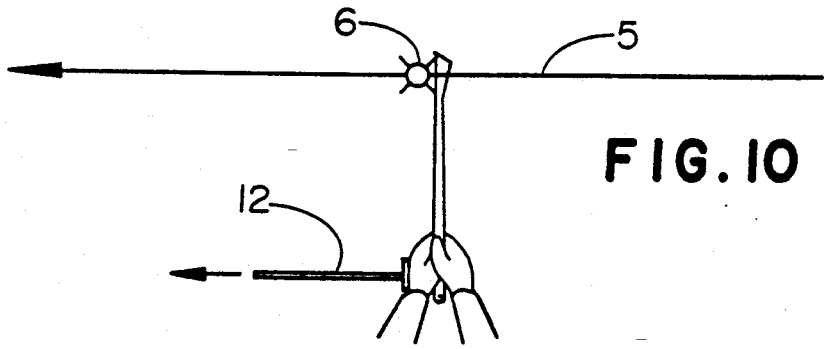
FIGS. 10–13 are plan views looking down on the golfer utilizing the training device of the present invention and which further illustrate the proper as well as improper vertical orientation of the pointer of the training device of the present invention relative to the vertical plane of the ball's flight path or target line of direction during the critical points of the golfer's golf stroke.

During "set-up", the pointer 12 is seen to be properly vertically oriented when the pointer 12 is oriented forwardly towards the target and substantially parallel to the vertical plane 5 of the target line of direction (FIG. 10).

Figure 11:
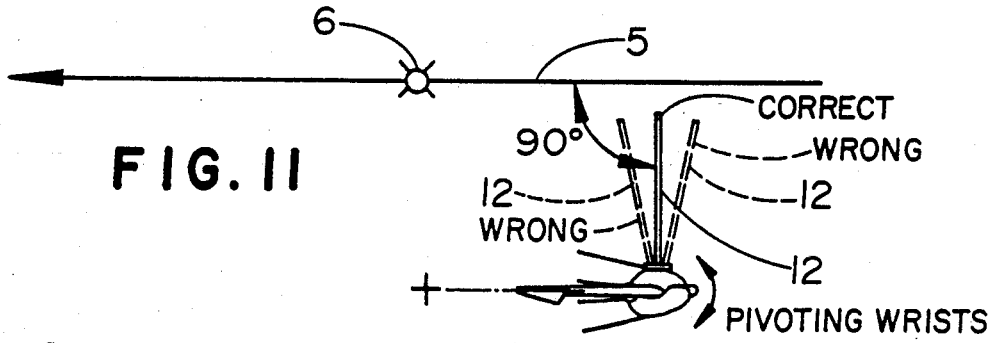

As seen in FIG. 11, at the top (apex) of the backswing of the golfer's stroke, the pointer 12 is seen to be properly vertically oriented when the pointer 12 is oriented towards the vertical plane 5 of the target line of direction and perpendicular to the vertical plane 5 of the ball's target line of direction, so that a substantially 90° angle is formed therebetween. If the pointer 12 is oriented towards the vertical plane 5 of the target line of direction, but, so that an angle is formed therebetween that is either substantially greater or less than 90°, then it is known that the golfer's hands are not properly vertically oriented at this critical position of the golf stroke.

Figure 12:
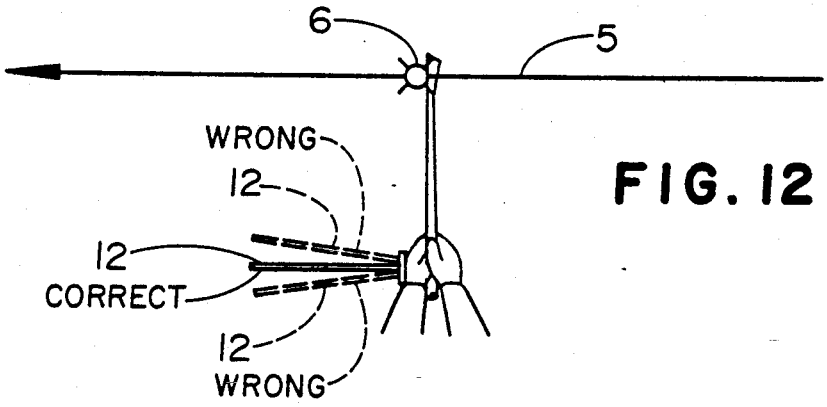

As seen in FIG. 12, at the point of the forward swing of the golf stroke where the face of the head of the golf club impacts the ball 6 (the point of impact), the pointer 12 is seen to be properly vertically oriented when the pointer 12 is oriented forwardly towards the target and substantially parallel to the vertical plane 5 of the target line of direction. If the pointer 12 is oriented, so that the pointer 12 intersects the vertical plane 5 of the target line of direction, then it is known that the golfer's hands are not properly vertically oriented at this critical position of the golf stroke.

Figure 13:
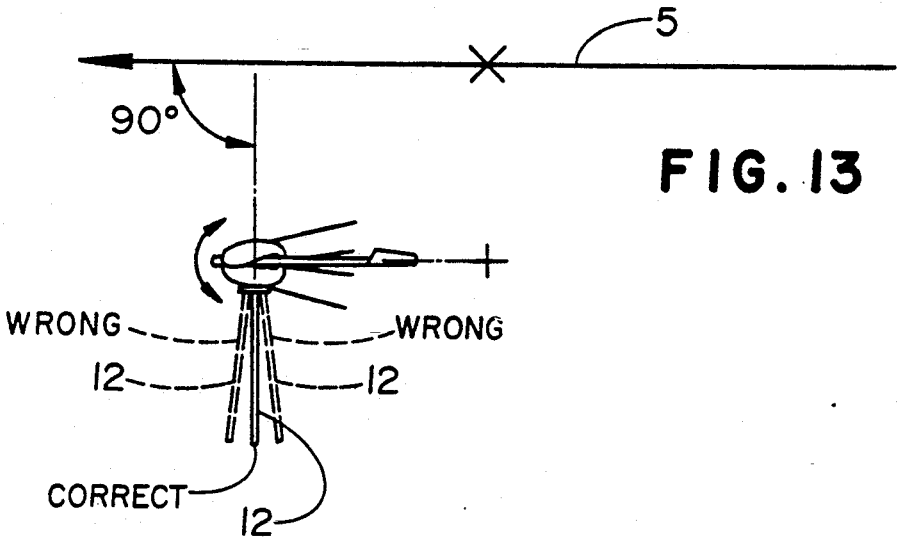

As seen in FIG. 13, at the apex of the forward swing of the golfer's stroke, the pointer 12 is seen to be properly vertically oriented when the pointer 12 is oriented rearwardly away from the target and substantially parallel to the vertical plane 5 of the ball's target line of direction. If the pointer 12 is oriented towards the vertical plane 5 of the target line of direction, so that the pointer 12 intersects the vertical plane 5 of the target line of direction, then it is known that the golfer's hands are not properly vertically oriented at this critical position of the golf stroke.

Figure 14:
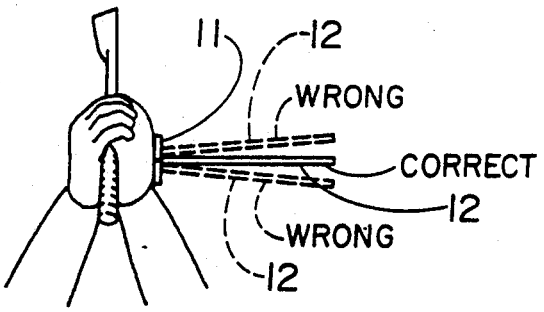
FIGS. 14–16 are elevation views of the golfer utilizing the training device of the present invention and which further illustrate the proper as well as improper horizontal orientation of the pointer of the training device of the present invention relative to the horizontal plane of the ground during the critical points of the golfer's golf stroke.
Figure 15:
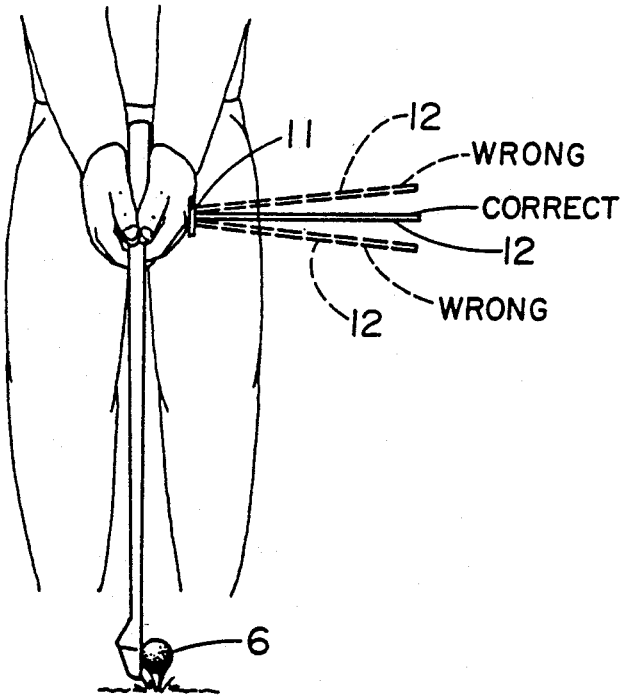
Figure 16:
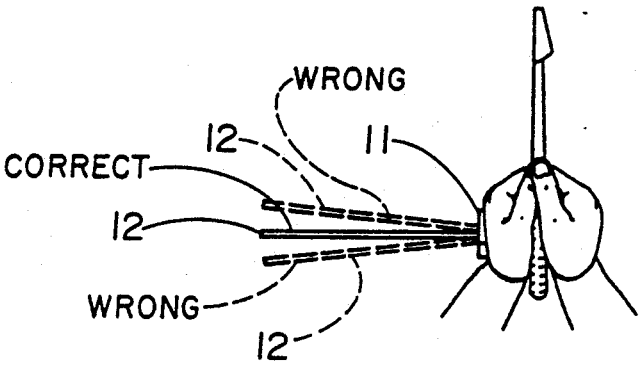

Referring now to FIGS. 14–16, when utilizing the training attachment 10 of the present invention, the proper as well as common improper horizontal orientations of the pointer 12 relative to the horizontal plane of the ground are illustrated during the critical points of the golfer's golf stroke.

As seen in FIG. 14, at the top (apex) of the backswing of the golfer's stroke, the pointer 12 is seen to be properly horizontally oriented when the pointer 12 is horizontally oriented parallel to the horizontal plane of the ground. If the pointer 12 is oriented so as to intersect the horizontal plane of the ground, then it is known that the golfer's hands are not properly horizontally oriented at this critical position of the golf stroke.

As seen in FIG. 15, at the point of the forward swing of the golf stroke where the face of the head of the golf club impacts the ball 6 (the point of impact), the pointer 12 is seen to be properly horizontally oriented when the pointer 12 is horizontally oriented parallel to the horizontal plane of the ground. If the pointer 12 is oriented, so that the pointer 12 intersects the horizontal plane of the ground, then it is known that the golfer's hands are not properly horizontally oriented at this critical position of the golf stroke.

As seen in FIG. 16, at the apex of the forward swing of the golfer's stroke, the pointer 12 is seen to be properly horizontally oriented when the pointer 12 is horizontally oriented parallel to the horizontal plane of the ground. If the pointer 12 is oriented so as to intersect the horizontal plane of the ground, then it is known that the golfer's hands are not properly horizontally oriented at this critical position of the golf stroke.

Many golfer's prefer not to wear a golfer's glove and the training device of the present invention may also be used by these golfers. Referring now to FIGS. 17–23, a means is shown for wearing the training device on the golfer's hand.

Figure 17:
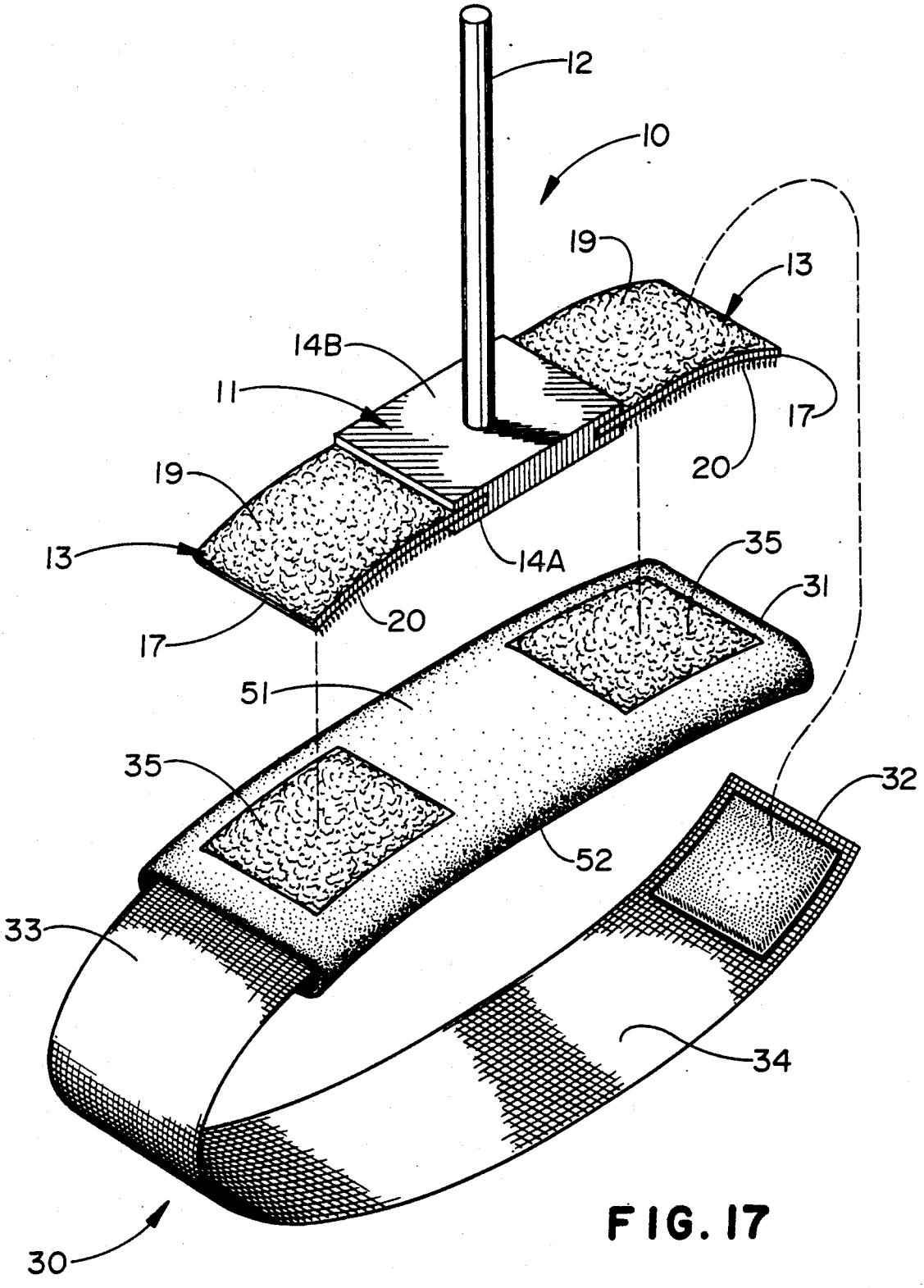
FIG. 17 is an exploded view of the training device of FIG. 1 removably secured to an elastic strap to be worn about a golfer's hand.
Figure 20:
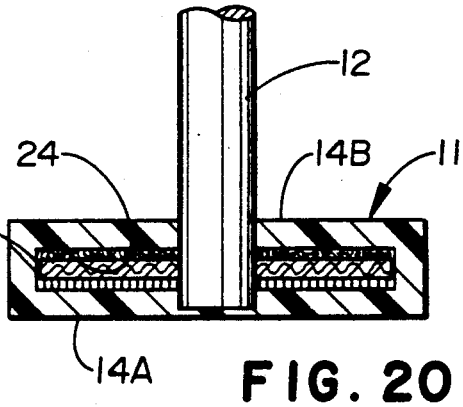
FIG. 20 is a cross section view taken along the lines 20—20 of FIG. 18.
Figure 18:
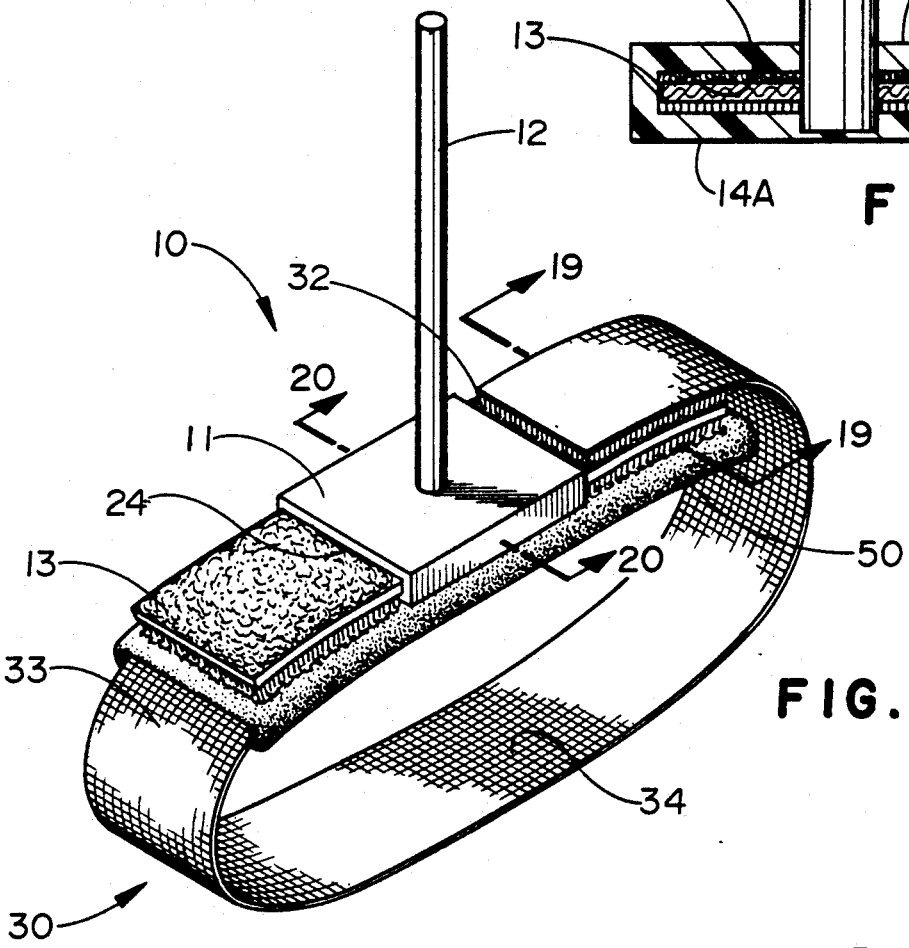
FIG. 18 is a perspective view of the training device of the present invention attached to the elastic strap.
Figure 19:
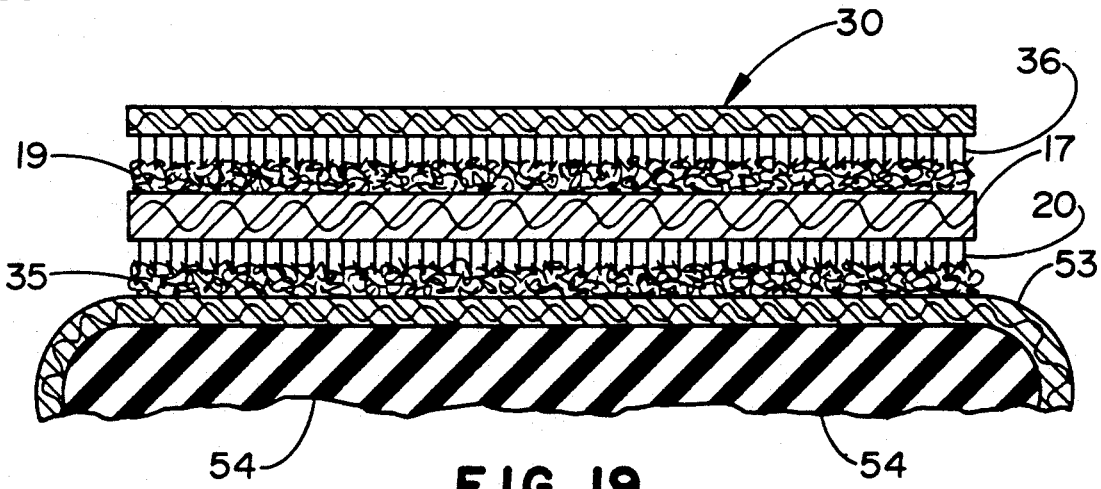
FIG. 19 is a cross section view taken along the lines 19—19 of FIG. 18.
Figure 21:
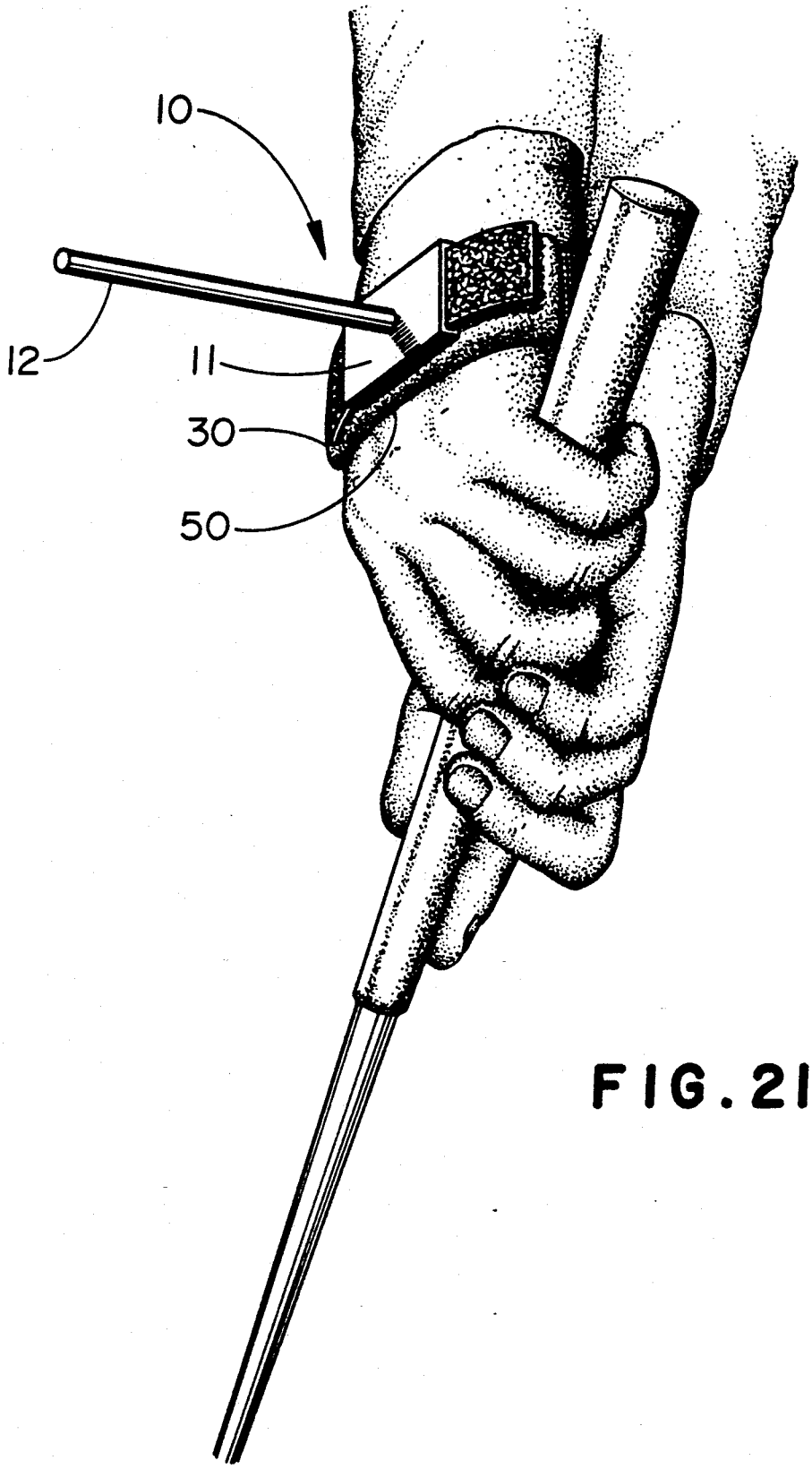
FIG. 21 illustrates the training device of the present invention worn on the hand of a golfer.
Figure 22:
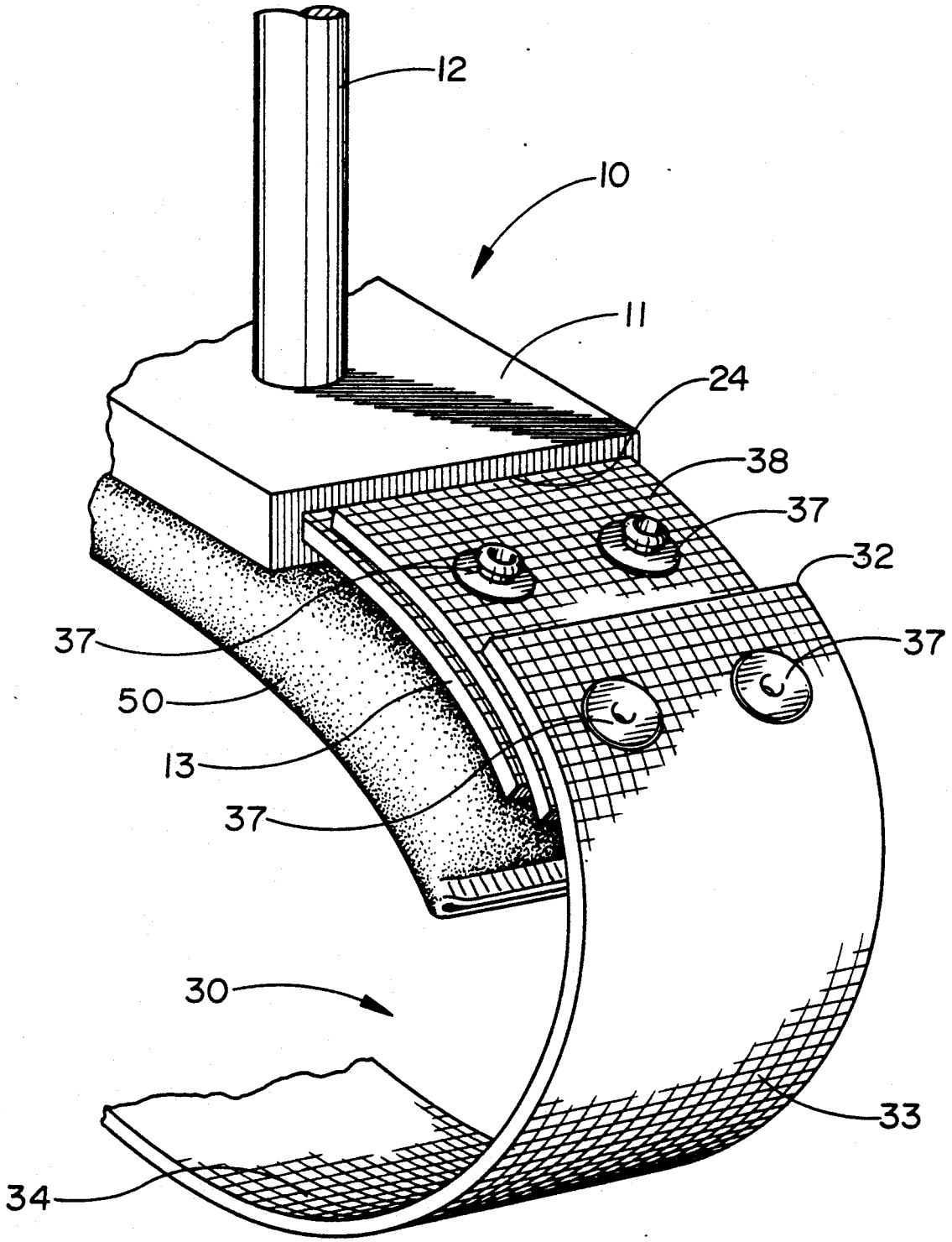
FIG. 22 is a perspective view of a snap means to secure the strap for wearing the device on the golfer's hand.

An elastic band 30 having a first end 31 and an opposite second end 32, a first side 33 and a second side 34 is provided. At least one attachment means 35 is mounted on the first side 33 of the band 30 near the first end 31. A further attachment means 36 is mounted on the second side 34 of the band near the second end 32 thereof. The securing means 13 on the base 11 of the device 10 are removably mated with the at least one attachment means 35 on the elastic band to fasten the device 10 to the elastic band 30. Preferably, the fastening means are hook and loop type fasteners, there being hook fasteners 20 on the underside of the securing means 13 and loop fasteners as the at least one attachment means 35. Although FIG. 17 shows the at least one attachment means 35 as two separate members, a single member, having a size to accommodate both securing means 13 on the device 10, may be used. This configuration of the means for wearing the device on the golfer's hand permits the device 10 used with the golfer's glove 1 to also be used by golfers without gloves with no changes in the device 10. The elastic band 30 may be wrapped about the golfer's hand with the second side 34 of the band 30 adjacent to the golfer's hand. In this manner, the at least one attachment means 35 is disposed on the backside of the golfer's hand. To secure the band 30 about the golfer's hand, the further attachment means 36 is attached to the securing means 13 on the base 11 of the device 10. Preferably, the further attachment means 36 includes hook and loop type fasteners for rapid and easy connection and to cooperate with the securing means 13 on the base 11 of the device 10. The further attachment means 36 may be male/female snaps 37 (FIG. 22) with cooperating female/male snaps on connecting segment 38. The connecting segment 38 is attached to the securing means 13 on the base 11 of the device 10, preferably by hook and loop fasteners. This feature retains the device 10 unchanged for use with and without golfer's gloves and permits the use of snap-type connectors. The use of several pairs of spaced-apart snap-type fasteners 37, together with the hook and loop fasteners provides a means to wrap about the hand of the golfer irrespective of the size of the hand. Other types of connectors may be used by persons skilled in the art.

Figure 23:
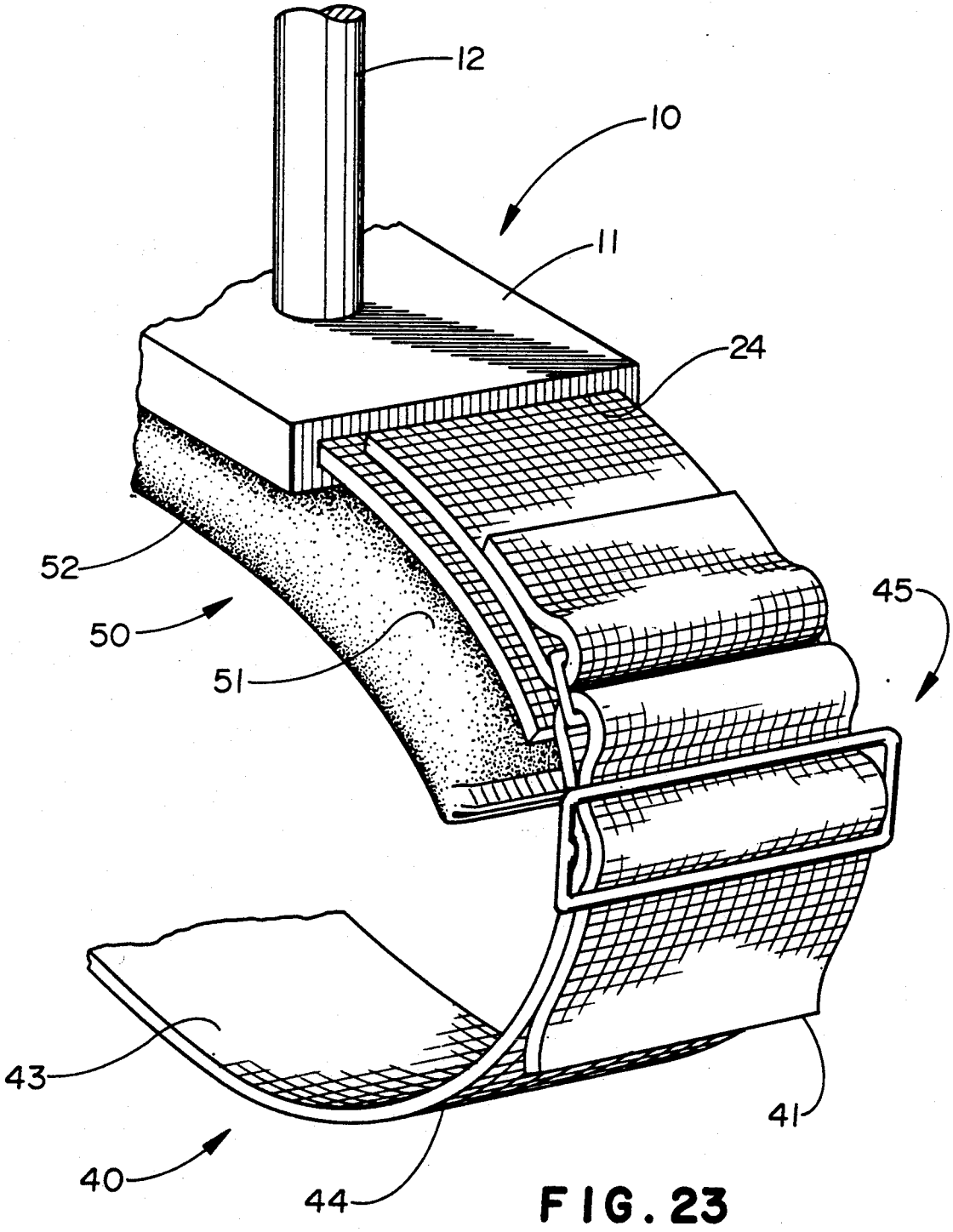
FIG. 23 is a perspective view of a buckle means to secure the strap for wearing the device on the golfer's hand.

As shown in FIG. 23, the means for wearing the device on the golfer's hand may be a strap means 40 having an end 41, a first side 43 and a second side 44. The strap means is similar to the elastic band 30 in that the device 10 may be attached to the strap means 40 so as to be disposed on the backside of the golfer's hand. A buckle means 45 is provided to connect the end 41 of the strap means to the second end 42 thereof. A typical buckle means 45 is shown in FIG. 23 but other buckle means, known to persons skilled in the art, may be used.

In order to permit the golfer to wear the device 10 more comfortably about the golfer's hand, a pad 50 may be placed on the end of the elastic band 30 or of the strap means 40. The pad has a first side 51 to which the device 10 is attached and a second side 52 which is in contact with the backside of the golfer's hand. The pad 50 is made from an outer layer 53 and a cushioned inner layer 54. Preferably the outer layer 53 is moisture resistant to prevent perspiration from entering the cushioned inner layer 54. The cushioned inner layer 54 may be foam type plastic or fabric. The elastic band 30 or strap means 40 may be attached to the top 51 or the bottom 52 of the pad, or alternately, may be inserted into the pad 50 between the top 51 and the bottom 52.

Thus it can be seen that the attachment 10 of the present invention may be used not only for vertically and horizontally orienting the golfer's hands in proper position at the start of the golf stroke and for indicating if the club is parallel to the flight path of the ball, but it is also useful for showing if the golfer's wrists are collapsing which will be revealed by the pointer 12 being oriented in directions or manners other than has been discussed above relative to the vertical plane of the target line of direction and the horizontal plane of the ground.

Figure 24:
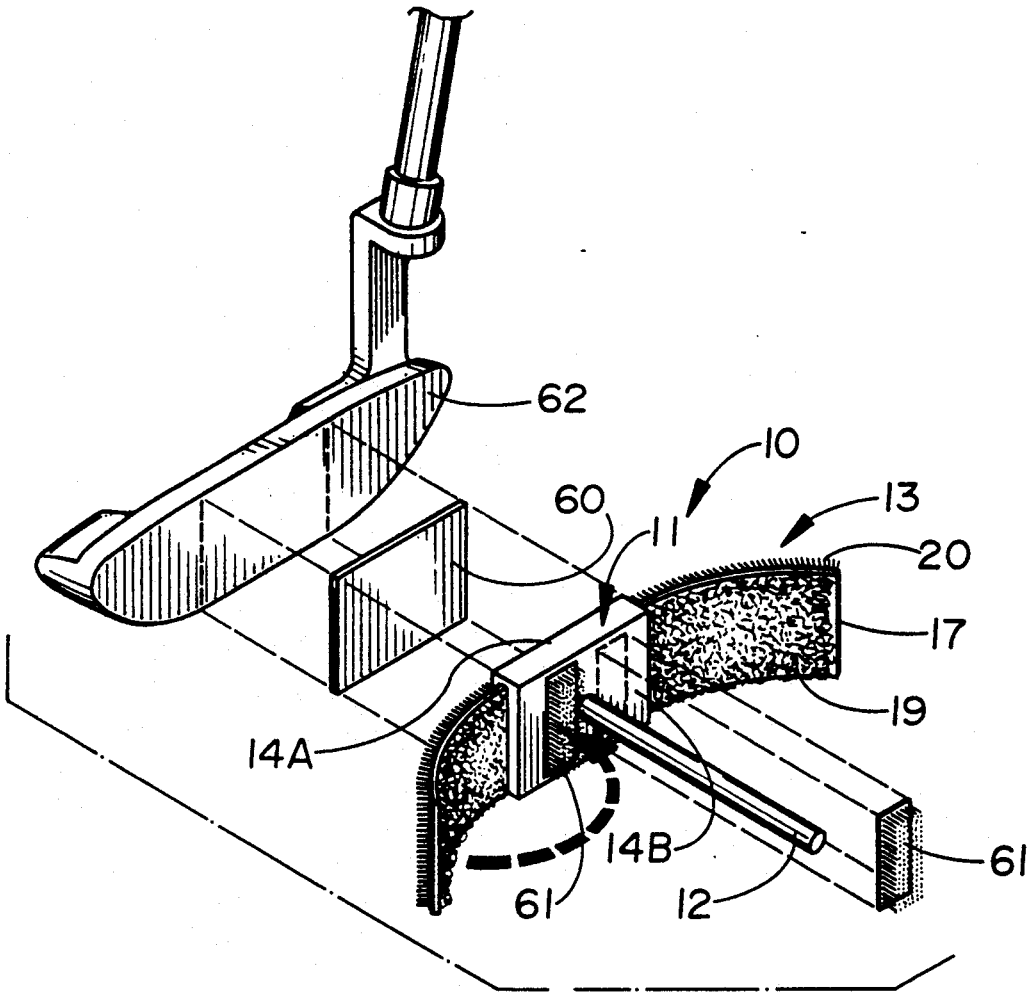
FIG. 24 is an exploded view of the training device attached to the head of a golf club.

Referring now to FIG. 24, the device may also have a magnet 60 attached to the bottom side 14A of the base 11. Preferably the magnet 60 is attached by an adhesive means. Also, two strips 61 having fastening means thereon are attached to the top side 14A of the base 11. The strips 61 are mounted on opposite sides of the dowel rod 12, i.e. the dowel rod 12 is between the strips 61. The securing means 13 carried by the base 11 are folded upwardly until the fasteners on the securing means 13 may be fastened to the fastening means on the respective two strips 61. Preferably hook and loop fasteners are disposed on both the securing means 13 and both of the strips 61, although other fastening means may be used. In this manner, the securing means 13 no longer extend outwardly from the base and the magnet 60 on the base 11 may be easily attached to the head of a golf club 62. This provides the golfer with an additional training device to improve and correct the golfer's stroke. Not only may the device be attached to the golfer's glove or hand, but the device may also be attached to the golf club where it is readily visible to the golfer and to an observer. During the golfer's stroke, the perpendicular and parallel orientation of the longitudinal axis of the pointer 12 relative to the vertical plane of the target line of direction and the horizontal plane of the ground may be observed for indicating whether the head of the club is properly aligned during the golf stroke. The same device 10 as is used on the hand, as described above, may be used with the head of the golf club by the addition of the magnet 60 and the strips of fastener 61. These can easily be added by use of adhesive backed components which can be provided as a separate kit if desired.

Figure 25:
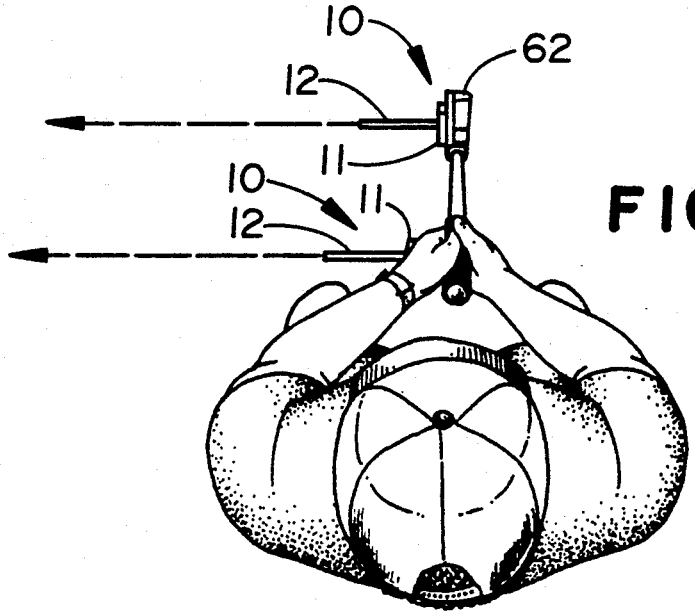
FIG. 25 is a perspective view showing the alignment of a device worn on the hand and a device attached to the head of a golf club.

Furthermore, a training device 10 worn on the golfer's glove or the golfer's hand can be used simultaneously with the training device 10 attached to the head of the golf club 62. When so used, both devices 10 can be observed to determine whether the respective rods 12 are parallel and indicating the proper alignment of the hand and the head of golf club 62 during the golfer's stroke (FIG. 25).

If desired, the device 10 could be formed without the securing means 13 extending from the base 11 and with as magnet 60 attached to the bottom side 14A of the base. This would not permit the device 10 to be worn on the hand but would allow use with the head of the golf club.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A golf stroke training device to be worn on the backside of a golfer's leading hand for indicating if the golfer's leading hand is properly aligned during the golfer's stroke relative to the vertical plane of a target line of direction and the horizontal plane of the ground, said device comprised of: means for wearing the training device on the golfer's hand; a base; a rod mounted on the base, so as to extend outwardly therefrom and from the backside of the golfer's leading hand, the rod having a longitudinal axis located so as to substantially perpendicularly intersect the base and the backside of the golfer's leading hand; means for attaching the base to the means for wearing the training device on the golfer's hand; whereby, when during the golfer's stroke, the orientation of the longitudinal axis of the rod relative to the vertical plane of the target line of direction and the horizontal plane of the ground may be observed for indicating whether the backside of the golfer's leading hand is properly aligned during the golfer's stroke, wherein the means for wearing the device on the golfer's hand comprises an elastic band having a first end and an opposite second end, a first side and a second side, at least one attachment means for attaching the base to the band, the at least one attachment means being mounted on the first side near the first end thereof and a further attachment means for attaching the base to the band mounted on the second side near the second end thereof, wherein the elastic band may be wrapped about the golfer's hand with the second side of the band adapted to contact the golfers's hand, the at least one attachment means being adapted to be disposed on the backside of the golfer's hand, the base of the device having securing means thereon for removably mating with the at least one attachment means on the first side of the band and the further attachment means being attached to the securing means on the base of the device.

2. The device of claim 1, wherein the securing means on the base of the device, the at least one attachment means and the further attachment means include hook and loop fasteners.

3. The device of claim 1, wherein the securing means on the base of the device, the at least one attachment means and the further attachment means include respective male and female snap-type fasteners.

4. A golf stroke training device to be worn on the backside of a golfer's leading hand for indicating if the golfer's leading hand is properly aligned during the golfer's stroke relative to the vertical plane of a target line of direction and the horizontal plane of the ground, said device comprised of: means for wearing the training device on the golfer's hand; a base; a rod mounted on the base, so as to extend outwardly therefrom and from the backside of the golfer's leading hand, the rod having a longitudinal axis located so as to substantially perpendicularly intersect the base and the backside of the golfer's leading hand; means for attaching the base to the means for wearing the training device on the golfer's hand; whereby, when during the golfer's stroke, the orientation of the longitudinal axis of the rod relative to the vertical plane of the target line of direction and the horizontal plane of the ground may be observed for indicating whether the backside of the golfer's leading hand is properly aligned during the golfer's stroke, an elastic band having a first end and an opposite second end, a first side and a second side, a pad mounted near the first end of the band wherein a second side of the pad is adapted to contact the backside of the golfer's hand and a first side of the pad has at least one attachment means for attaching the base to the band, such that the securing means on the base of the device may be attached to the pad, the pad permitting the training device to be worn comfortably by the golfer.

5. The device of claim 4, wherein the rod has a distinctive color thereon for improved visibility.

6. A golf stroke training device to be worn on the backside of a golfer's leading hand for indicating if the golfer's leading hand is properly aligned during the golfer's stroke relative to the vertical plane of a target line of direction and the horizontal plane of the ground, said device comprised of: means for wearing the training device on the golfer's hand; a base; a rod mounted on the base, so as to extend outwardly therefrom and from the backside of the golfer's leading hand, the rod having a longitudinal axis located so as to substantially perpendicularly intersect the base and the backside of the golfer's leading hand; means for attaching the base to the means for wearing the training device on the golfer's hand; whereby, when during the golfer's stroke, the orientation of the longitudinal axis of the rod relative to the vertical plane of the target line of direction and the horizontal plane of the ground may be observed for indicating whether the backside of the golfer's leading hand is properly aligned during the golfer's stroke, wherein the means for wearing the device on the golfer's hand comprises a strap having a first end, an opposite second end, a first side and a second side, a buckling means for connecting the first end of the strap to the second end of the strap wherein the strap is adapted to be wrapped about the golfer's hand with the second side of the strap adapted to be adjacent to the golfer's hand, at least one attachment means for attaching the base to the band, the at least one attachment means being mounted on the first side near the first end of the strap, the at least one attachment means adapted to be disposed on the backside of the golfer's hand, the base of the device having securing means thereon for removably mating with the at least one attachment means on the first side of the strap.

7. The device of claim 6, wherein the securing means on the base of the device and the at least one attachment means on the first side of the strap are hook and loop fasteners.

8. A golf stroke training device to be worn on the backside of a golfer's leading hand for indicating if the golfer's leading hand is properly aligned during the golfer's stroke relative to the vertical plane of a target line of direction and the horizontal plane of the ground, said device comprised of a base, means for wearing the device on the wearer's hand comprising an elastic band having a first end and an opposite second end, a first side and a second side, a pad mounted near the first end of the band, the pad having a first side and a second side, the first side of the pad having thereon at least one attachment means for attaching the base to the band, a further attachment means for attaching the base to the band, the further attachment means mounted on the second side of the elastic band near the second end thereof wherein the elastic band is adapted to be wrapped about the golfer's hand with the second side of the band and the second side of the pad adapted to be adjacent to the golfer's hand, the base of the device having securing means thereon for removably mating with the at least one attachment means on the first side of the pad, the further attachment means being attached to the securing means on the base of the device; the securing means on the base of the device, the at least one attachment means and the further attachment means being hook and loop fasteners; a rod mounted on the base, so as to extend outwardly therefrom and from the backside of the golfer's leading hand, the rod having a longitudinal axis located so as to substantially perpendicularly intersect the base and the backside of the golfer's leading hand, whereby, when during the golfer's stroke, the orientation of the longitudinal axis of the rod relative to the vertical plane of the target line of direction and the horizontal plane of the ground may be observed for indicating whether the backside of the golfer's leading hand is properly aligned during the golfer's stroke.

9. A golf stroke training device to be worn on the backside of a golfer's leading hand for indicating if the golfer's leading hand is properly aligned during the golfer's stroke relative to the vertical plane of a target line of direction and the horizontal plane of the ground, said device comprised of: means for wearing the training device on the golfer's hand, the means having a first side and a second side; a base having a top side and a bottom side, the base including fasteners carried thereby and which extend therefrom for removably mating with at least one fastener on the first side of the means for wearing the training device on the golfer's leading hand, whereby the bottom side of the base of the attachment is adapted to be disposed against the backside of the golfer's leading hand when the base is secured to the fasteners on the first side of the means for wearing the training device on the golfer's leading hand; a dowel rod mounted on the top side of the base, so as to extend outwardly therefrom and from the backside of the golfer's leading hand, the dowel rod having a longitudinal axis located so as to substantially perpendicularly intersect the base and the backside of the golfer's leading hand; whereby, when during the golfer's stroke, the perpendicular and parallel orientation of the longitudinal axis of the pointer relative to the vertical plane of the target line of direction and the horizontal plane of the ground may be observed for indicating whether the backside of the golfer's leading hand is properly aligned during the golfer's stroke.

10. The device of claim 9, wherein the means for wearing the device on the golfer's hand comprises an elastic band having a first end and an opposite second end, the at least one fastener on the first side of the wearing means being mounted near the first end and a further attachment means being mounted on the second side of the wearing means near the second end thereof, wherein the elastic band is adapted to be wrapped about the golfer's hand with the second side of the band adapted to be adjacent to the golfer's hand with the further attachment means being attached to the fasteners on the base of the device.

11. The device of claim 9, wherein the means for wearing the device on the golfer's hand comprises a strap having a first end and an opposite second end, a buckling means to connect the first end of the strap to the second end of the strap, wherein the strap is adapted to be wrapped about the golfer's hand with the second side of the strap adapted to be adjacent to the golfer's hand.

12. A golf stroke training device to be worn on the backside of a golfer's leading hand for indicating if the golfer's leading hand is properly aligned during the golfer's stroke relative to the vertical plane of a target line of direction and the horizontal plane of the ground, said device comprised of: means for wearing the training device on the golfer's hand, the means having a first side and a second side; a base including fasteners thereon for removably mating with fasteners on the first side of the means for wearing the training device, whereby the device is removably secured to the fasteners on the first side of the means for wearing the device on the golfer's leading hand; the fasteners on the base including hook and loop fasteners, and further wherein the fasteners on the backside of the first side of the means for wearing the device on the golfer's leading hand include hook and loop fasteners; a dowel rod mounted on the base, so as to extend outwardly therefrom and from the backside of the golfer's leading hand, the dowel rod having a longitudinal axis located so as to substantially perpendicularly intersect the base and the backside of the golfer's leading hand; whereby, when during the golfer's stroke, the perpendicular and parallel orientation of the longitudinal axis of the dowel rod relative to the vertical plane of the target line of direction and to the horizontal plane of the ground may be observed for indicating whether the backside of the golfer's leading hand is properly aligned during the golfer's stroke.

* * * * *